United States Patent [19]

Gruber

[11] Patent Number: 4,793,714

[45] Date of Patent: Dec. 27, 1988

[54] APPARATUS FOR MIXING FLUIDS

[75] Inventor: Bruno Gruber, Ehbauer-Ring, Fed. Rep. of Germany

[73] Assignee: Achmed N. Sadik, Ottawa, Canada; a part interest

[21] Appl. No.: 16,149

[22] Filed: Feb. 18, 1987

[51] Int. Cl.[4] ..... B01F 15/02; B01F 13/02

[52] U.S. Cl. ..... 366/150; 261/81; 261/122; 366/101; 366/114; 366/275

[58] Field of Search ..... 366/275, 150, 101, 102, 366/103, 104, 106, 107, 154, 111, 114, 108; 261/81, 122

[56] References Cited

U.S. PATENT DOCUMENTS

| | | | |
|---|---|---|---|
| 2,124,983 | 7/1938 | Martin | 366/275 |
| 2,420,691 | 5/1947 | Vang | 261/81 |
| 2,856,273 | 10/1958 | Beber | 366/102 |
| 3,097,828 | 7/1963 | Grun | 366/106 |
| 4,353,668 | 10/1982 | Anderson | 366/101 |

*Primary Examiner*—Robert W. Jenkins

*Attorney, Agent, or Firm*—Saidman, Sterne, Kessler & Goldstein

[57] ABSTRACT

Apparatus for mixing two fluids, which could be a gas and a liquid or two liquids, comprises a planar distribution outlet for the gas or one of the two liquids closing an otherwise airtight chamber and a vibrating membrane as a wall of the chamber. Tbe distribution outlet may itself be a vibrating perforated membrane.

9 Claims, 2 Drawing Sheets

APPARATUS FOR MIXING FLUIDS

BACKGROUND OF THE INVENTION

1. Field of the Invention

The present invention relates to apparatus for mixing fluids by means of induced vibrations and a fluid flow or distribution outlet. More particularly, the invention relates to an apparatus for mixing two liquids or a gas and a liquid.

2. Prior Art of the Invention

A gas distribution arrangement is known from DE - OS 25 14 197 having a movable outlet connected to a laterally disposed vibration generator. The vibration generator causes lateral oscillations, i.e. parallel to the plane of the gas outlets in the porous surface area of the gas distributor device. Due to the oscillations of the gas distributor in lateral direction shearing forces act on the gas bubbles exiting from the gas outlets and frees them to form fine gas bubbles in a liquid. The considerable energy needed by the vibration generator which is necessary to move the gas distributor device is, however, a disadvantage.

A device for production of gas bubbles is also known from DE-PS 30 39 969. Submerging a gas distributor device with fine apertures into a liquid, it starts oscillating automatically with continuous air supply, thus producing fine air bubbles in a pulsating mode. A disadvantage in this case is that it is not possible to produce a constant and continuous gas bubble output.

On the other hand, numerous arrangements are known for mixing fluids or liquids. In such known arrangements, a liquid is introduced into another by means of mechanically produced turbulence. It is necessary to expand a large amount of kinetic energy to produce mixtures or emulsions by such known arrangements. The attendant rise in temperature is also often undesirable.

SUMMARY OF THE INVENTION

A general object of the invention is to provide an arrangement and apparatus, whereby less energy is used to introduce significant quantities of one fluid or liquid, finely distributed, into another liquid without the necessity of inducing turbulence and an attendant rise in temperature.

A narrower object of the invention is to provide a device making it possible to put great quantities of finely spread gas into liquid with little expenditure of energy.

The arrangement of the present invention comprises a fluid distributor having a perforated membrane affixed to an otherwise airtight chamber into which a continuous fluid supply flows and which has a vibration source inducing pulsation in the fluid in the chamber, thus causing the fluid distributor to release fine gas bubbles in a surrounding liquid in synchronism with the vibration frequency.

The oscillating fluid compression is caused by a membrane that represents for example the bottom of the generator chamber and is made to oscillate by means of a vibration generator.

However, the oscillating membrane may also be perforated and being simultaneously the gas distribution outlet itself. In this case, the gas distribution outlet is directly connected to the vibration source, and most suitably installed in the upper or lateral part of the chamber.

The vibration source can also act on a membrane that is mounted at the bottom of the chamber and rigidly connected with the fluid distribution outlet at the top of the chamber by means of a rod or rods.

The fluid distribution outlet or the membrane, as the case may be, vibrates vertically with respect to the plane of fluid distribution exit by means of the vibration source which could be an electro-magnetically driven vibrator.

The fluid distribution outlet is appropriately installed in an otherwise airtight chamber with one upper aperture, and the distribution outlet is affixed to the circumferential edge of the casing with the fluid supply line leading into the chamber. Thus, the fluid distribution outlet maybe attached to a chamber having arbitrary geometry.

The fluid distribution outlet is preferably a membrane with numerous small apertures.

The fluid distribution outlet may also be a rigid perforated plate with flexible fastening along its edges.

The vibration source is rigidly connected with the fluid distribution outlet in a known manner causing it to vibrate.

The number and size of the fluid bubbles released may be varied by means of the quantity of fluid supplied, number and size of the holes in the fluid distribution outlet, the frequency and the amplitude of the vibrations of the vibration generator. Release of fluid bubbles from the outlet ensues as the vibration generator exerts pressure on the gas distribution outlet on the membrane, thereby increasing fluid pressure at the fluid distribution outlet.

BRIEF DESCRIPTION OF THE DRAWINGS

Preferred embodiments of the invention will now be described in conjunction with the drawings, in which.

DETAILED DESCRIPTION OF THE PREFERRED EMBODIMENTS

Figure 1:
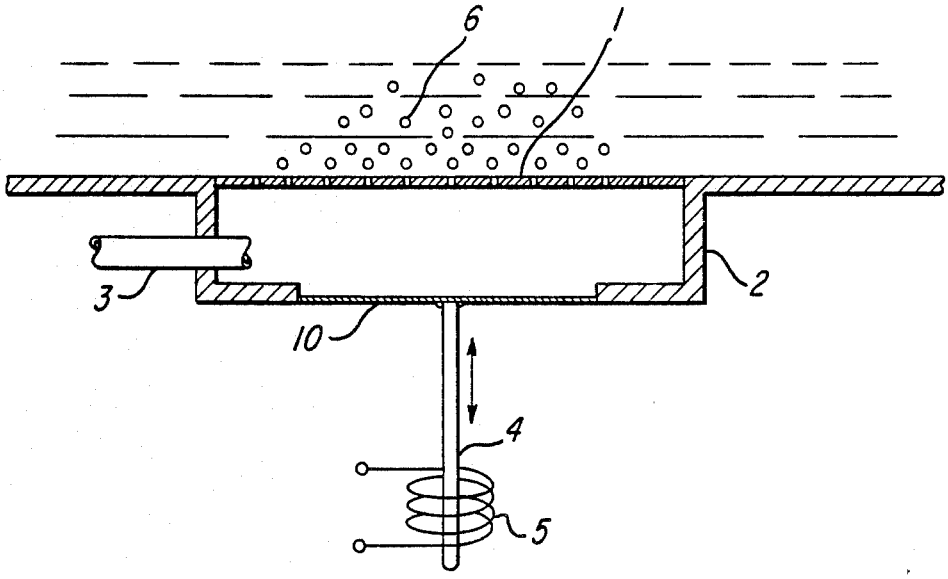
FIG. 1 illustrates in cross-section a fluid mixing apparatus according to the present invention.

FIG. 1 shows in cross-section an apparatus having a gas or liquid distribution outlet 1 fastened to the edge of an otherwise airtight chamber 2 equipped with a gas or liquid supply line 3 and a vibration source 5 that acts on a membrane 10 via a rigid rod 4, thus causing the gas in the chamber 2 to pulsate so that tee gas distribution outlet 1 releases fine gas bubbles 6 into a surrounding liquid in synchronism with the vibration frequency.

Figure 2:
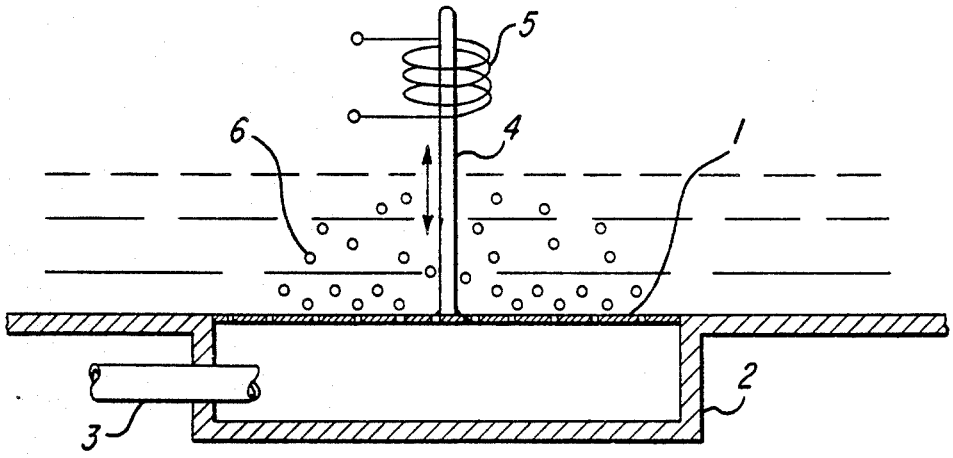
FIG. 2 illustrates in cross-section an alternative apparatus for mixing fluids according to the present invention.

FIG. 2 shows in cross-section an apparatus equipped with a perforated membrane serving also as the gas distribution outlet 1 which is fastened to the airtight chamber 2 wherein the vibration source 5 acts on the gas distribution outlet 1 by means of the rigid rod 4.

Figure 3:
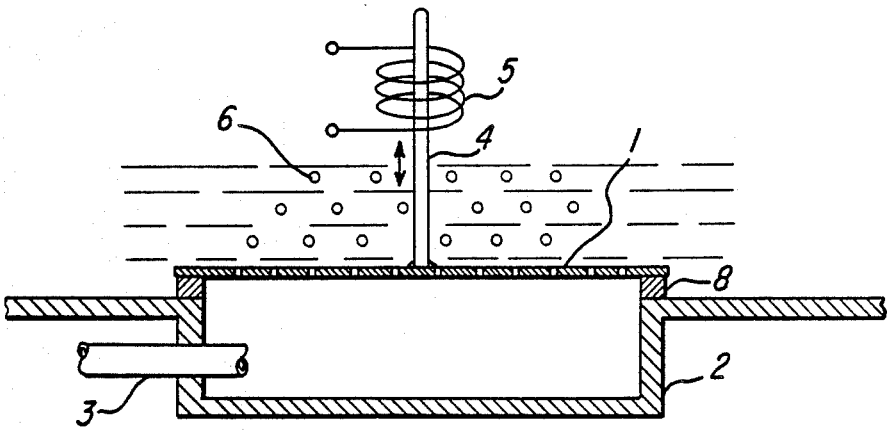
FIG. 3 illustrates, in cross-section a further alternative apparatus for mixing fluids according to the present invention.

FIG. 3 illustrates in cross-section an apparatus equipped with a rigid perforated plate serving as the gas distribution outlet 1 which is fastened to the airtight chamber 2 via a flexible intermediate layer 8 (e.g. rubber) wherein the vibration source 5 acts on the gas distribution outlet 1 via rigid rod 4.

Figure 4:
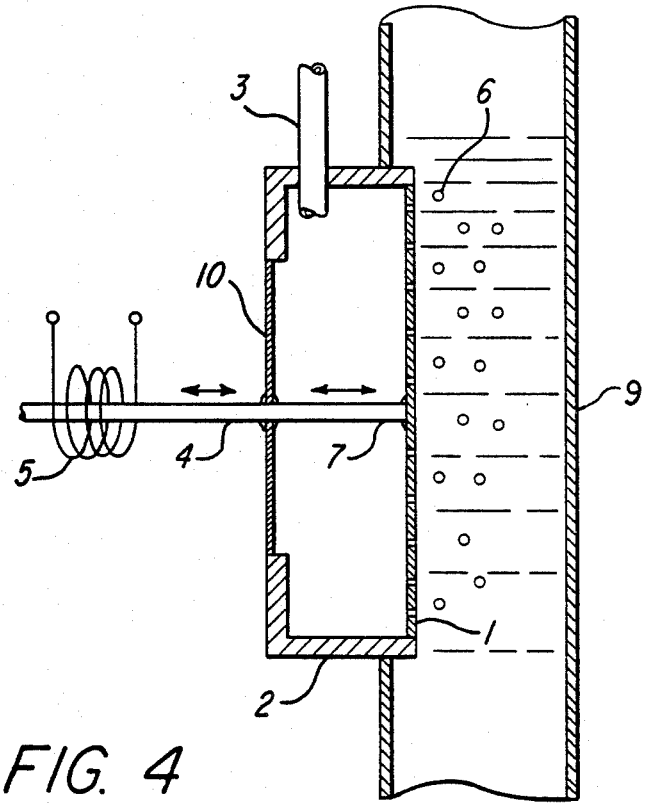
FIG. 4 illustrates in cross-section yet another alternative implementation of the apparatus for mixing fluids according to the present invention.

FIG. 4 shows a cross-section of a device with liquid distribution outlet 1 inserted laterally into a tube 9 filled with liquid. The vibration source 5 acts on the membrane 10 and further on the distribution outlet 1 by means of an extension rod 7 inside the chamber 2. In this embodiment the distribution outlet 1 is a perforated, vibrating, membrane in addition to the membrane 10.

I claim:

1. Apparatus for mixing two fluids, comprising:

a fluid distribution outlet, having a plurality of fluid exits disposed in a plane, closing an otherwise airtight chamber;

vibration generating means connected to a membrane forming a wall of said airtight chamber by means of non-resilient vibration transfer means; and means for introducing a first fluid into said airtight chamber; whereby vibrations in said membrane compress said first fluid through said fluid distribution outlet and mixingly distribute it into a second fluid on the other side of the fluid distribution outlet.

2. Apparatus as defined in claim 1, said first fluid being a gas and said second fluid being a liquid.

3. Apparatus as defined in claim 1, said first and second fluids being liquids.

4. Apparatus as defined in claims 1, 2, and 3, said fluid distribution outlet being a perforated membrane.

5. Apparatus as defined in claims 1, 2, or 3, said fluid distribution outlet being a mesh-like membrane.

6. Apparatus as defined in claims 1, 2, or 3, said membrane being perforated and identical with said fluid distribution outlet.

7. Apparatus as defined in claims 1, 2, or 3, said membrane being rigidly connected to said fluid distribution outlet.

8. Apparatus as defined in claims 1, 2, or 3, said fluid distribution outlet being a rigid perforated plate closing said chamber by means of an intermediate elastic seal.

9. Apparatus as defined in claims 1, 2, or 3, said vibration generating means being an electromagnetic oscillator.

* * * * *